US005970900A

United States Patent [19]

Sheldon et al.

[11] Patent Number: 5,970,900

[45] Date of Patent: Oct. 26, 1999

[54] DIVING TOW BOARD

[75] Inventors: Patric Sheldon, Islamorada, Fla.; George A. LaMarca, West Des Moines, Iowa; Gary Skrobeck, Islamorada, Fla.

[73] Assignee: Florida Outdoor Sports, Inc., Islamorada, Fla.

[21] Appl. No.: 09/061,780

[22] Filed: Apr. 16, 1998

[51] Int. Cl.[6] ..... B63B 21/04

[52] U.S. Cl. ..... 114/253; 114/315; 441/65; 441/69

[58] Field of Search ..... D21/803; 114/253, 114/254, 315; 441/69, 65

[56] References Cited

U.S. PATENT DOCUMENTS

| | | | |
|---|---|---|---|
| D. 239,727 | 4/1976 | Stormer | D21/803 |
| 2,709,266 | 5/1955 | Munn | 114/315 |
| 3,353,232 | 11/1967 | Brownson | 114/253 |
| 3,861,347 | 1/1975 | Christenson | 441/69 |
| 5,568,783 | 10/1996 | Ditchfield | 114/315 |

*Primary Examiner*—Stephen Avila
*Attorney, Agent, or Firm*—Robert M. Downey, P.A.

[57] ABSTRACT

A streamlined towable diving board is provided for use on top of or beneath the surface of water. The board is equipped with ergonomically contoured handles featuring pistol grips and an approximate five degree radius of curvature equipped with a soft, pliable covering. The board is designed to be floatable and to automatically return to the surface upon being released by the user underwater.

5 Claims, 2 Drawing Sheets

DIVING TOW BOARD

BACKGROUND OF THE INVENTION

This invention relates to the field of handheld swimming and/or diving boards or wings used to assist a swimmer or diver to control his ascent and descent as he propels himself through the water. More particularly, this invention relates to an improved means of controlling one's descent and ascent in a safe and efficient manner while being towed behind a surface marine vessel.

Wing-like shaped swimming and/or diving boards have been disclosed in the prior art for use by swimmers, surfers, and divers, etc. A partial listing of these might include surf boards, skiing boards and skis themselves. Normally, the user of such boards grasps or holds them by their edge or the boards may be equipped with shoe-like clamps for attachment to the user's feet. Such boards have been made in a variety of shapes and sizes.

An apparatus similar to the present invention has been described in the prior art. Applicant, in U.S. Pat. No. Des. 239,727, described a Surf Diver Foil for use by a swimmer to assist in controlling the swimmer's ascent and descent as the swimmer propelled himself through the water. However, no means were provided on the board for allowing it to be towed by a marine vessel which would thereby save energy and reduce the fatigue on the user of the board. Furthermore, certain safety features and other improvements of the present invention were not found on the Surf Diver Foil as previously described by the applicant or other prior art. These deficiencies in the prior art have been remedied by the present invention.

SUMMARY OF THE INVENTION

The board of the present invention comprises a streamlined and contoured rigid surface or body being thicker at its leading edge and thinner at its trailing edge having two oppositely disposed handles with one on each side of the body. The body is designed so that the top half of the board is symmetrical with its bottom half so that no force is exerted normal or perpendicular to the board as it travels through the water which force would move the board generally upward or generally downward with movement through the water. In operation, the user can execute a shallow dive; i.e., descent, by merely rotating his wrists and thereby direct the board toward a downward inclination. The hydrodynamic design of the board produces a water flow or pressure over the top of the forward moving board causing the user to descend. Tipping or rotation of the board in an upward incline will return the user to the surface as a result of opposing hydrodynamic pressure on the bottom of the board.

The board of the present invention is equipped with oppositely disposed uniquely designed handles for grasping by the user of the board. The handles are located on either side edge of the board being disposed slightly toward the front or leading edge of the board. The handles are ergonomically designed to fit the user's hand so as to provide a superior surface for gripping, and, additionally, to provide extra comfort to the user so as to prevent stress and muscle fatigue to the user. The handles are equipped with "pistol-style" grips for conformance between and to the fingers and hand of the user, and, also the handles are shaped so that there is an approximate five degree radius of curvature associated with the horizontal plane of the handles. Further, the handles are covered with a foam rubber-like material, e.g., HYPOLON, or similar soft, pliable fabric. The concave face of the radius of curvature is oriented toward the rear or trailing edge of the board, contributing to the streamlined design of the board thereby decreasing its resistance to movement through the water.

A critical design element of the tow board of the present invention is the addition of a keyhole shaped notch or recess molded into the front of the board near the leading edge where the handles and board meet. This design feature creates an automatic up incline on the board while in tow. This upward incline occurs when the tow rope is slipped over the handles and through the keyhole shaped notches, and a half hitch knot is secured in the rope under each handle on the bottom of the board, thereby forcing the board to travel behind the vessel with a naturally occurring upward incline. The buoyancy of the board along with the forward motion of the board underwater with its upward incline, will cause the board to automatically come to the surface when released underwater. This feature prevents the board from crashing to the bottom and possibly hanging up while being towed forward without having a user to guide it. It also signals to the observer aboard the surface marine vessel that the user has let go or released the board so the operator of the vessel can shift into neutral and pick up the user of the board.

Other features of the board of the present invention include the fact that the board is floatable. Thus, the board will naturally float to the surface where it can serve as a flotation device for the user.

As can be seen, significant deficiencies in the prior art are overcome by the present invention. It can be seen that an object of the present invention is to provide a diving board that is safer for the user. This is accomplished by designing this board to automatically return to the surface upon release, and, by the fact that it is floatable. A further object of the present invention is to provide a board which is more comfortable and less fatiguing for the user. This is accomplished by designing the board so that it is towable and is equipped with ergonomically designed handles.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
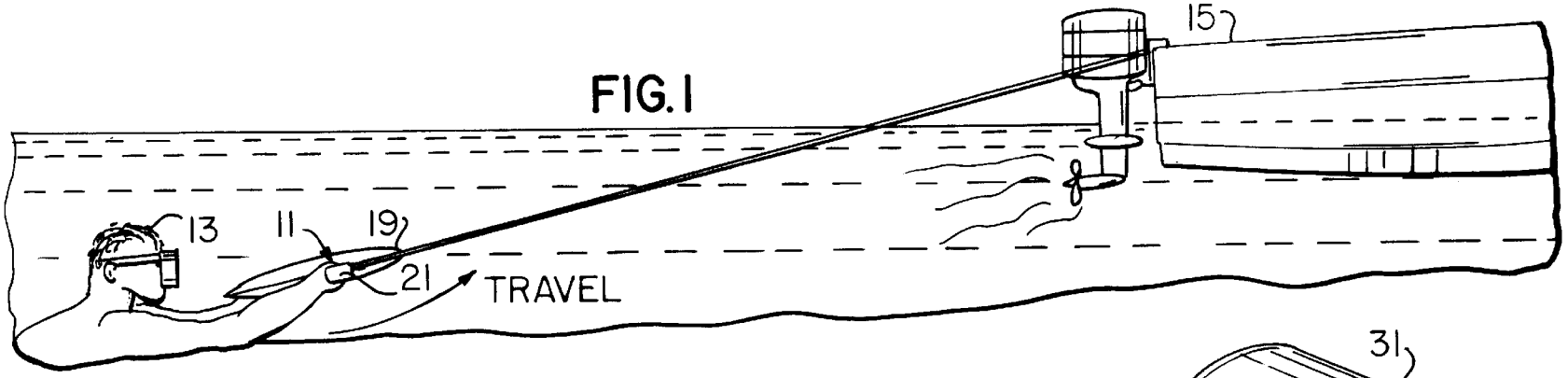
FIG. 1 is one embodiment of the present invention shown in operative connection.

Turning to FIG. 1, therein is shown one embodiment of the diving board or wing of the present invention in operative connection with a surface marine vessel. Therein is generally shown the diving board 11, being held in the hands of a swimmer 13. The board of the present invention 11 is connected to the surface marine vessel 15 by means of a rope 17. The rope 17 is attached to the handles 21 on the two sides of the board near the leading edge of the board by being slipped over the handles and through the keyhole shaped notches or recesses 19. By tying a half hitch knot in the rope and threading the rope under and through the keyhole shaped notch, a counterclockwise rotational torque is exerted on the board to give the board an automatic upward incline caused by the pull or force of the rope as the board is towed through the water.

Figure 2:
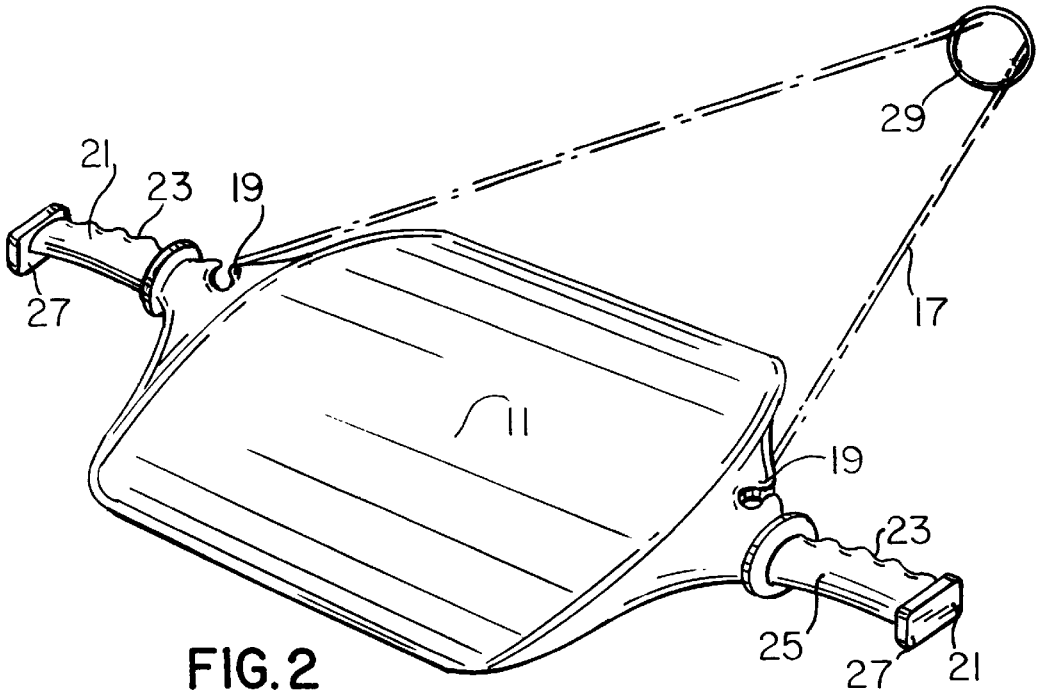
FIG. 2 is a perspective view of the present invention.

FIG. 2 is a perspective drawing of the invention shown generally at 11. The board 11 is a rigid surface of sufficient size to accommodate use by a swimmer for guiding the swimmer through or in the water. The rope for connection to the surface marine vessel is shown at 17. The two keyhole shaped notches or recesses where the rope is attached to the board are shown at 19. The handles of the board are generally shown at 21, being equipped with pistol grips 23, and further having an approximate five degree radius of curvature. Furthermore, the handles are covered and thereby equipped with a covering being soft and pliable in nature, e.g., HYPOLON or like material at 25. Furthermore, the handles have an enlarged lip 27 shown on its end in order to further secure the soft, pliable coating to prevent it from being removed and to prevent the user's hand from slipping off the handle. Also shown is a ring 29 through which the rope passes. The tow rope 17 is a selected material designed with an approximate 1" spliced loop at each end. Passing the tag end through the loop creates a half hitch that slides over the handles 21, passes through the keyhole notch 19, and attaches via the half hitch to the bottom of the handle. Before the second end of the tow rope is attached to the board, it is passed through an approximate 1" diameter, stainless steel, or like material, tow ring 29. The second end of the tow rope is attached to the board and a simple over hand knot is tied to secure the stainless ring in the center of the tow rope so the board will tow straight. There are no metal crimps or fasteners of any kind needed to secure the tow rope to the board or to hold the stainless tow ring to the tow rope.

Figure 3:
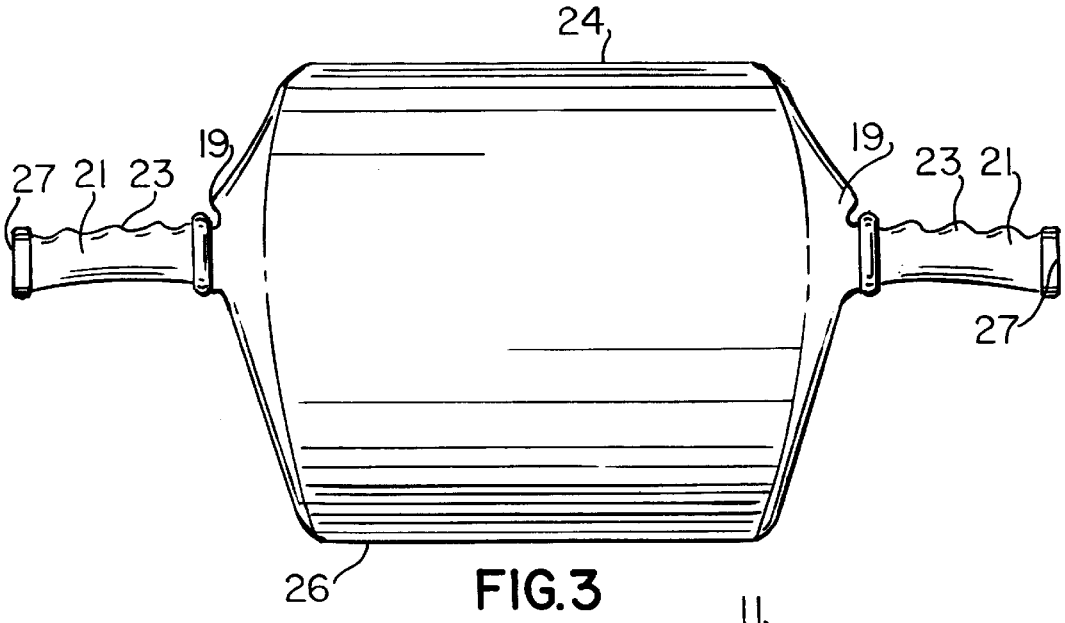
FIG. 3 is a top view of the present invention.

FIG. 3 is a top view of the invention showing the keyhole shaped notch or recess 19 where the rope is tied. Also shown are the pistol grip handles 21 along with the lipped ends 27. The pistol grips of the handles are shown at 23. FIG. 3 clearly shows the pistol grips 23 of the handles, and, likewise, shows the approximate five degree radius of curvature with the concave aspect of the radius of curvature facing toward the rear or trailing edge of the board so as to contribute to the streamlined design of the board. The front or leading edge of the board is shown at 24, with the rear or trailing edge of the board being shown at 26.

Figure 4:
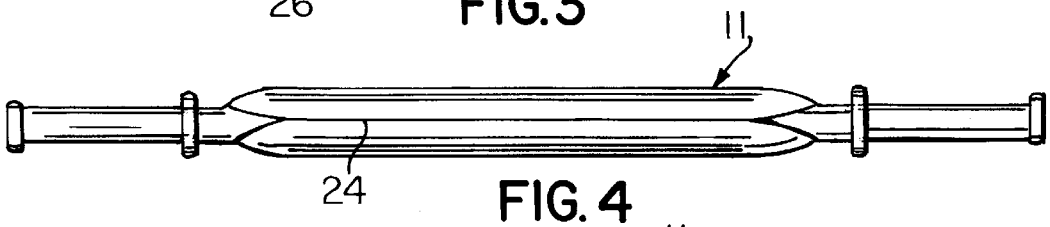
FIG. 4 is a front view of the present invention.

FIG. 4 is a front view of the board 11 showing the leading edge 24.

Figure 5:
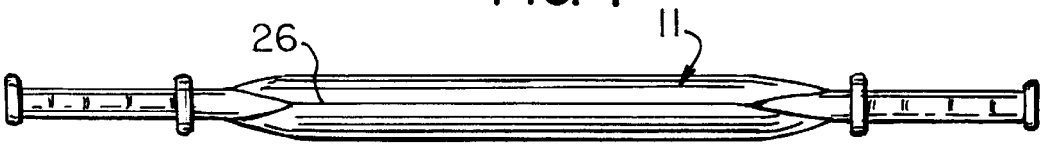
FIG. 5 is a rear view of the present invention.

FIG. 5 is a rear view of the board 11 showing the trailing edge 26, with the trailing edge being somewhat thinner than the leading edge.

Figure 6:
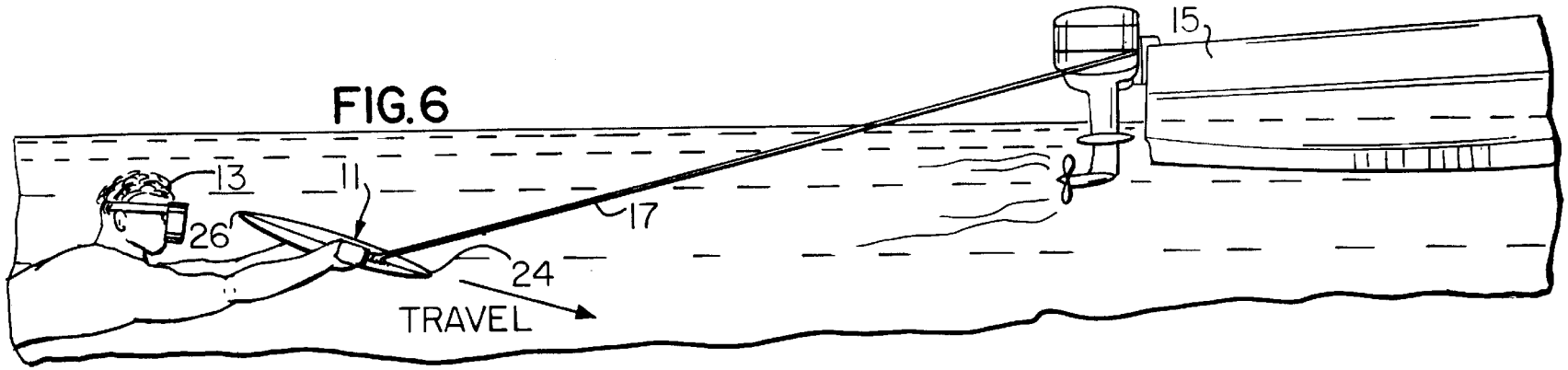
FIG. 6 is one embodiment of the present invention shown in operative connection.

FIG. 6 shows an embodiment of the present invention in operative connection. Therein is shown the present invention 11, being held in the hands of a swimmer 13. The board 11 is connected to the surface marine vessel 15 by means of a rope 17. The rope 17 is attached near the front half of the board at the keyhole shaped notch 19. FIG. 6 shows the board 11 having a downward incline so as to cause the swimmer to descend.

Figure 7:
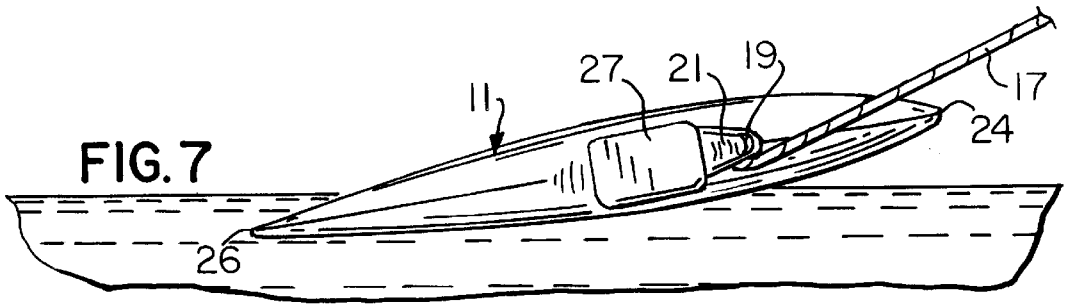
FIG. 7 is one embodiment of the present invention shown in operative connection.

FIG. 7 shows the present invention 11 in operative connection with a rope 17. When the tow rope is slipped over the handles and through the keyhole notches 19, and a half hitch knot is secured under each handle on the bottom of the board, it forces the board to travel behind the vessel with an upward incline. The buoyancy of the board along with the forward motion of the board underwater, with its natural upward incline, will cause the board to automatically come to the surface when released underwater. This feature prevents the board from crashing to the bottom while being towed forward without the user being present to guide it.

Figure 8:
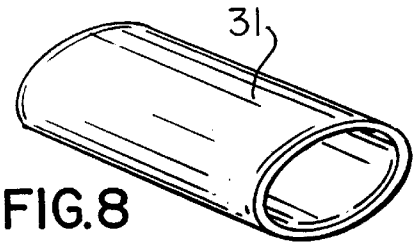
FIG. 8 is a perspective view of the covering of the handles.

FIG. 8 shows the soft pliable covering, e.g., HYPOLON, 31, for the handles. As can be seen, it is designed to be slipped over the enlarged lips of the ends of the handles 27 and held in the hands of the user. One of the key design elements of the board is HYPOLON fitted handles, a foam rubber-like material selected for its contribution to reducing muscle fatigue as well as providing a secure and comfortable grip surface. In order to accomplish the incorporation of the covering material or fabric, the handle design is recessed and includes a five degree radius. The handles are lipped at each end to accommodate the thickness of the covering and secure it so it will not come off. The production process for adding the covering will require two steps after the board comes out of the injection molding machine. First, the handles are coated with an epoxy based cement to hold the approximate 4" piece of covering firmly to the handle. Next, heating the covering will allow it to expand and slip over the lipped handle. After cooling, the covering will shrink to conform to the pistol grip handles molded into the board.

It should be understood that the teachings of this specification and drawings with reference to particular components, alignments, relationships and the like, are given by way of illustration and explanation thereof and not by way of limitation because changes in the invention may be effected without departing from the scope and spirit of the invention as contained herein.

Now that the invention has been described,

What is claimed is:

1. A diving tow board for use in water comprising:

a main body formed of buoyant materials to cause the diving tow board to float on a surface of the water when in a relaxed state, said main body including an upper half and a symmetrical lower half, a leading edge, a trailing edge, and opposite side portions, and said main body including a streamlined, hydrodynamically contoured shape for moving efficiently through the water;

a pair of handles each being integral with and extending outwardly from a respective one of said opposite side portions, said handles each including a distal end having an enlarged lip, a proximal end with an enlarged knob, and a hand grip zone therebetween, each of said handles further being structured and configured to include a radius of curvature between said proximal end and said distal end so that a concave side of each of said handles is directed towards a rear of the diving tow board;

means for attaching a tow rope to the diving tow board for towing the diving tow board through the water and including a keyhole-shaped notch formed in each of said opposite side portions, adjacent to and inboard of each of said proximal ends of said pair of handles, said keyhole notch being structured and disposed to direct the tow rope under said side portion and forwardly, towards said leading edge, so that the tow rope applies a torque force to said main body, causing said main body to be positioned in a normally upwardly inclined orientation, with said leading edge disposed higher than said trailing edge, thereby causing the diving tow board to return to the surface of the water when externally applied downward inclination torque forces are removed from said pair of handles; and each of said pair of handles including a tubular section of a soft and pliable cover material fitted tightly about said hand grip zone for ease of gripping said pair of handles.

2. The diving tow board as recited in claim 1 wherein said radius of curvature of said pair of handles is approximately 5°.

3. The diving tow board as recited in claim 1 wherein said hand grip zone of each of said pair of handles is provided with a pistol-style grip for conformance between and to the fingers when gripping said pair of handles.

4. The diving tow board as recited in claim 1 wherein said main body is thicker at said leading edge relative to said trailing edge.

5. The diving tow board as recited in claim 3 wherein said tubular sections of said soft pliable handle covers are sized and configured for snug, tight fitted receipt about said hand grip zone between said enlarged lip of said distal end and said enlarged knob of said proximal end of each of said pair of handles.

* * * * *